United States Patent [19]

Peregrim et al.

[11] 4,301,734

[45] Nov. 24, 1981

[54] CASE MOUNTED MOORING SYSTEM

[75] Inventors: Frank Peregrim; James B. Johnson, both of Silver Spring; Gerhard B. Winkler, Rockville, all of Md.

[73] Assignee: The United States of America as represented by the Secretary of the Navy, Washington, D.C.

[21] Appl. No.: 97,480

[22] Filed: Nov. 26, 1979

[51] Int. Cl.[3] ..... F42B 22/16

[52] U.S. Cl. ..... 102/413

[58] Field of Search ..... 102/13, 14

[56] References Cited

U.S. PATENT DOCUMENTS

| | | | |
|---|---|---|---|
| 940,506 | 11/1909 | Broomell | 102/13 |
| 947,230 | 1/1910 | Gabriel | 102/13 |
| 1,039,254 | 9/1912 | Carteron | 102/13 |
| 1,154,272 | 9/1915 | Senger et al. | 102/10 |
| 1,506,784 | 9/1924 | Sperry | 102/13 |
| 1,542,543 | 6/1925 | Elia | 102/13 |
| 1,546,921 | 7/1925 | Elia | 102/13 |
| 1,670,078 | 5/1928 | Pratt | 102/13 |
| 2,706,948 | 4/1955 | Turlay | 102/13 |
| 2,892,401 | 6/1959 | Michelson | 102/14 |
| 3,195,460 | 7/1965 | Kalaf | 102/16 |

*Primary Examiner*—Charles T. Jordan

*Attorney, Agent, or Firm*—R. S. Sciascia; A. L. Branning; W. R. Henderson

[57] ABSTRACT

A system for mooring a buoyant case such as a marine mine or other marine device at a preselected depth below the surface of the water in which the case was launched. After the case has been launched, together with an attached anchor, the anchor and case separate to the extent of a resilient line as they descend through the water. When the case passes through a first preselected depth the resilient line is released from the case, thereby permitting a mooring line, which is connected in series between the resilient line and the case, to payout. As the mooring line unwinds the anchor descends to the ocean floor while the buoyant case ascends toward the surface. When the case ascends through a second preselected depth a brake assembly is activated to stop the payout of the mooring line. After the case has been positioned at the second depth, a locking assembly fixes the position of the case at the mooring depth.

9 Claims, 4 Drawing Figures

CASE MOUNTED MOORING SYSTEM

BACKGROUND OF THE INVENTION

The present invention relates to a mooring system for mooring a buoyant case at a preselected depth, and more particularly to a mooring system for underwater mines.

Marine mines and other marine devices are launched from airborne platforms, submarines or surface ships. The physical limitation of each type of launch facility limits the overall weight and size of a combined anchor, mine and mooring mechanism. It is thus evident that a reliable, compact and lightweight mooring mechanism will permit either a greater amount of ordnance to be carried on each individual mine, thus increasing the effectiveness of the mine, or a greater number of mines or other marine devices to be carried and launched from the launching facility, thus increasing the effectiveness of the launching facility.

Prior art mooring systems include devices wherein a plummet line serves to position the mine a fixed distance below the surface. The anchor is equipped with a hydrostatic gripper which is set to actuate when the plummet line strikes the ocean floor causing the anchor to grip the mooring line and pull the mine down to a predetermined depth.

Devices have also been proposed in which a hydrostat is attached to the mooring line near the buoyant case so as to form a bight in the line which is not subject to the tension created by the anchor. As the anchor descends and reaches a set depth the hydrostat is actuated by the increased water pressure which causes the bight in the mooring line to be released. The momentary release of tension on the mooring line acts as a signal to a drum to cease further payout of the mooring line.

Other devices have been proposed whereby the entire buoyant case and anchor sink to the ocean floor and the case is then released to ascend to the selected depth. A hydrostat attached to the case senses the selected depth and signals the mooring line drum on the anchor to cease payout of the mooring line.

SUMMARY OF THE INVENTION

Accordingly, in the present invention, an improved mooring system is attained by providing a buoyant case with an anchor detachably secured thereto by a retaining band and explosive bolt. Shortly after launching of the case and anchor, the explosive bolt is fired by command signal from within the case. The case and anchor then separate to the length of a resilient line connected therebetween.

When the buoyant case and anchor, coupled by the resilient line, pass through a first preselected depth, a time delayed, resilient line release assembly is hydrostatically activated to release the resilient line from the buoyant case. The opposite end of the resilient line is also connected in series with a mooring line which is stored on a reel in the buoyant case. The reel is secured in a locked position until the reel locking assembly is hydrostatically released shortly after case/anchor separation.

When the resilient line is released from the case after a time delay, the mooring line begins to unwind from the storage reel. The initial movement of the mooring line unlocks a hydrostatically activated braking assembly. As the mooring line unwinds, the anchor continues to descend to the ocean floor while the buoyant case begins to ascend to the surface.

After the anchor has reached the ocean floor, the buoyant case ascends through a second preselected depth where a hydrostatically activated braking assembly terminates the ascent of the case. The time delayed release of the resilient line from the buoyant case assures that the anchor will reach the ocean floor prior to the case ascending through the second preselected depth or mooring depth. After the case is positioned at the mooring depth, the reel locking assembly is reactivated by dissolution of a corrodible disc and the case is permanently moored at the selected mooring depth.

If the anchor reaches the ocean floor before the case has passed through the first preselected depth, the time delayed release assembly will not be activated and the case will remain moored to the anchor by the resilient line. After the case has been moored by the resilient line, a corrodible plug is dissolved to lock the resilient line release assembly and permanently moor the case at the lesser depth.

OBJECTS OF THE INVENTION

It is therefore an object of the invention to provide a mooring system that is simple, compact and reliable.

Another object is to provide a mooring system which can be deployed from a surface, submerged or aerial platform to automatically moor a buoyant case, mine or other marine device at a preselected mooring depth.

Yet another object is to provide a mooring system that begins the time delayed payout of mooring line before the anchor reaches the ocean floor.

Another object is to provide a mooring mechanism that can withstand the shock and oscillation associated with the termination of mooring line payout.

Still another object is to provide a mooring mechanism which provides for the time delayed payout of mooring line after passing a first preselected depth and termination of the payout of mooring line at a second preselected depth.

Other objects, advantages and novel features of the present invention will become apparent from the following detailed description of the invention when considered in conjunction with the accompanying drawings.

BRIEF DESCRIPTION OF THE DRAWINGS

A more complete appreciation of the invention and many of the attendant advantages thereof will be readily understood by reference to the following detailed description when considered in conjunction with the accompanying drawings in which like reference numerals designate like parts throughout the figures and wherein.

DESCRIPTION OF THE PREFERRED EMBODIMENTS

Figure 1:
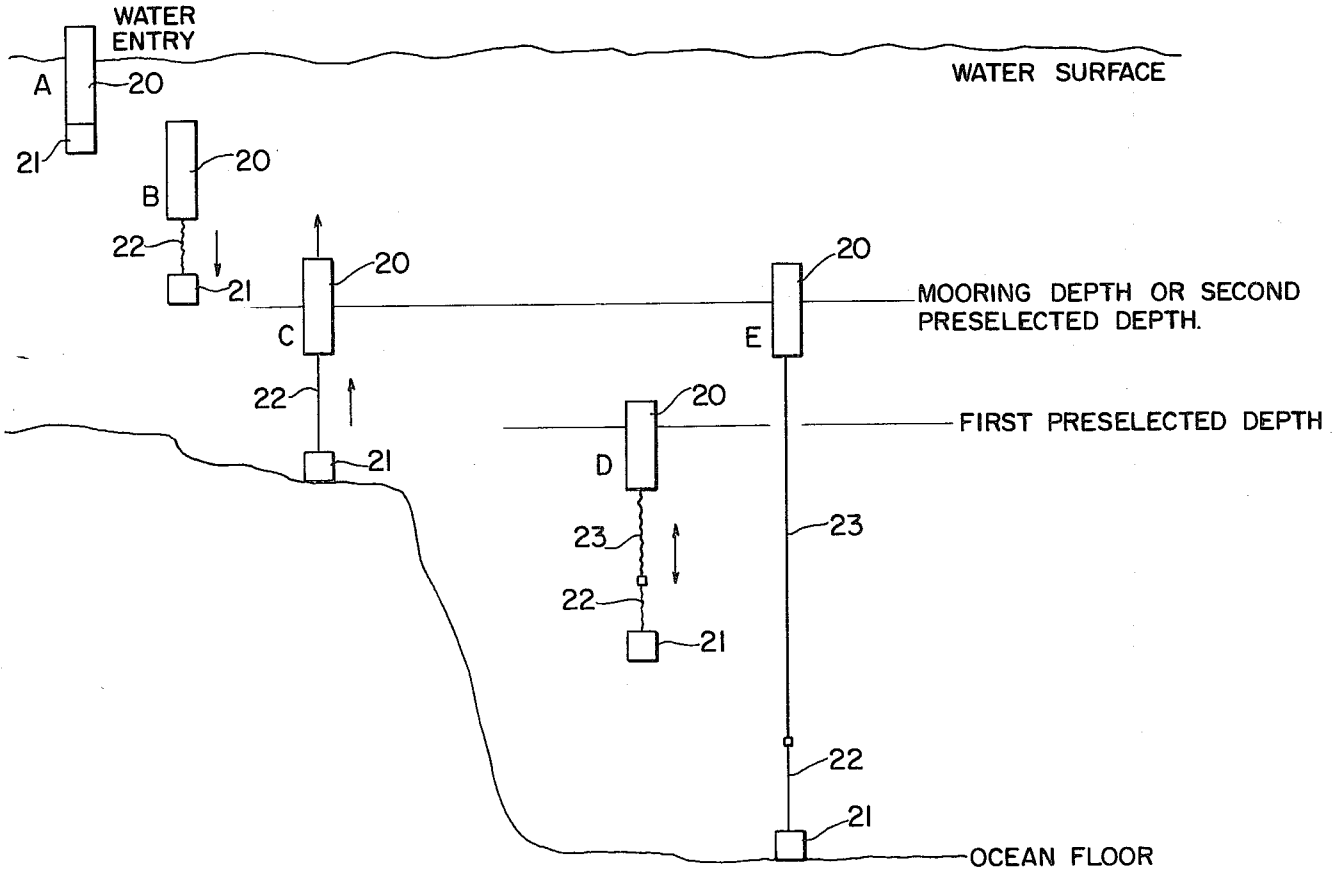
FIG. 1 shows in diagrammatic form the mooring sequence of the mine mooring system according to the present invention.

Referring now to FIG. 1, there is shown in diagrammatic form the mooring sequence for the mooring system according to the present invention. At position A, a buoyant case 20 with attached anchor 21 is launched into the water from a surface, submerged or airborne platform (not shown).

After launching, the case and anchor sink together until separated by an explosive bolt initiated by a command signal generated by a device in the buoyant case. Upon detonation of the explosive bolt, the case and anchor separate to the extent of a resilient line 22 which has one end attached to anchor 21 and an opposite end releasably secured to buoyant case 20, shown in position B. The opposite end of resilient line 22 is also connected in series with mooring line 23 which is stored on a reel in case 20 for subsequent payout.

The case and anchor continue to descend through the water coupled only by resilient line 22. If the case and anchor have been launched in shallow water, the anchor may come to rest on the ocean bottom with the case moored to the anchor only by resilient line 22, as shown by position C.

If the case and anchor have been launched in deep water, when the case descends through a first preselected depth the resilient line is released from the buoyant case by a hydrostatically actuated time delayed release assembly. The resilient line is connected in series with mooring line 23 which begins to unwind from the reel when the resilient line is released from the case. As the mooring line unwinds, the anchor continues to descend and the buoyant case begins to ascend from its position, illustrated at position D. The payout of the mooring line also unlocks a hydrostatically actuated braking assembly mounted on the case.

After the anchor has reached the ocean floor, the case ascends through a second preselected depth which actuates a braking assembly to terminate the ascent of the mine case, as shown at position E. When the case has been positioned at the second depth, a locking assembly is activated by dissolution of a corrodible disc to permanently moor the case at the second depth.

If the case has been moored in shallow water, as shown in position C, the dissolution of a corrodible plug locks the resilient release assembly so as to permanently moor the case by the resilient line only.

Figure 2:
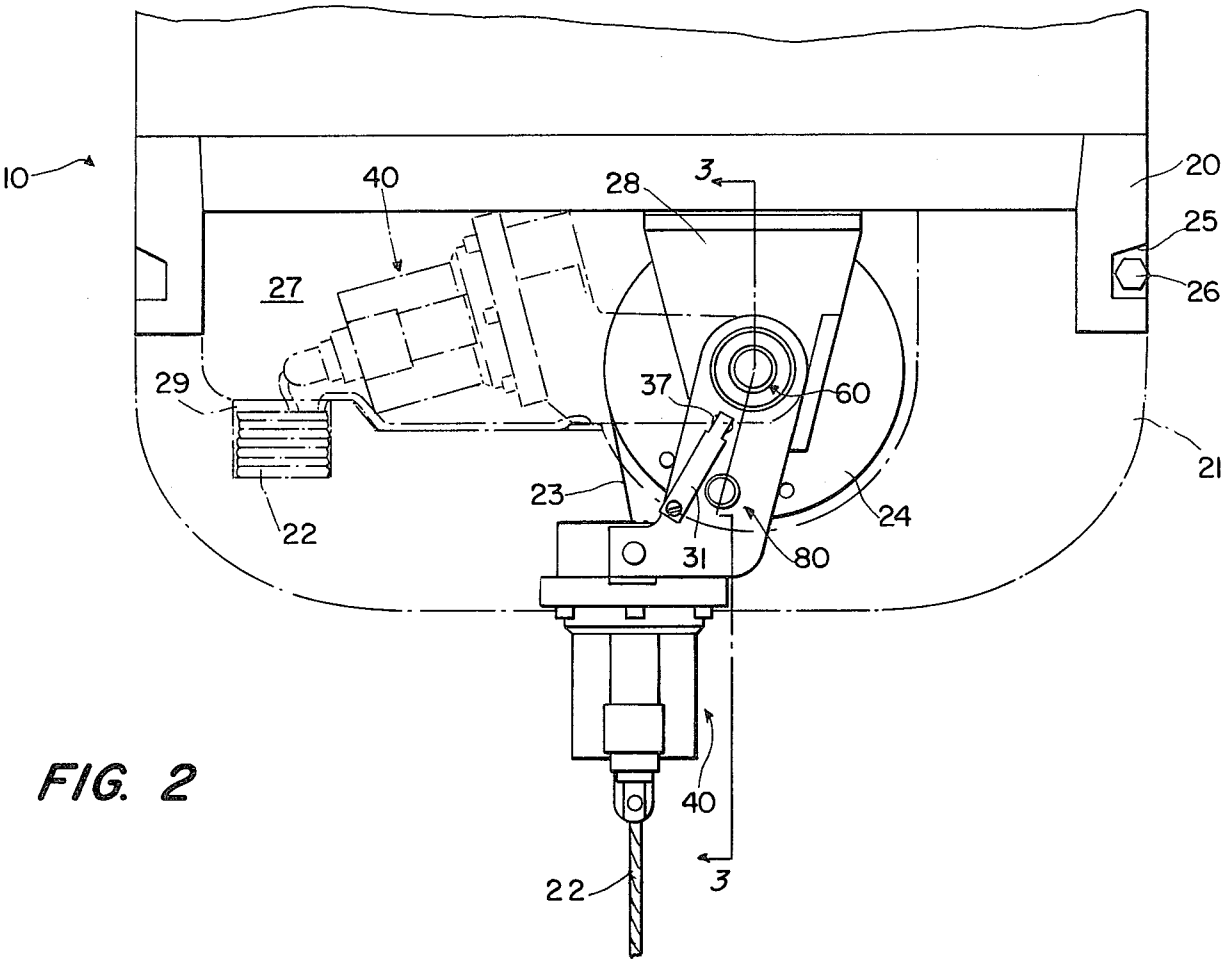
FIG. 2 shows a side view of the lower end of the buoyant case with the anchor attached thereto shown in partial cross-section.

Referring to FIG. 2, there is illustrated a mine mooring system 10 having a buoyant case 20 and anchor 21. The anchor is attached to one end of the case by a ball and groove retaining band 25 which is secured by explosive bolt 26. The face of anchor 21 which abuts the case is recessed to form reel cavity 27. Reel bracket 28 is mounted on the end of the case. The bracket rotatably carries support storage reel 24 and pivotally supports resilient line release assembly 40 both in its stored position (phantom outline) and its operative position when the anchor is separated from the case. The anchor is also provided with resilient line cavity 29 for storage of the resilient line.

When explosive bolt 26 is detonated, the anchor and case separate to the extent of the resilient line 22 and the resilient line release assembly 40 pivots down into the vertical position, shown by solid line in FIG. 2. The release assembly is locked into the vertical position by a flat spring 31 which is fixed to the release assembly at one end and is provided with pin 37 at the opposite end which extends through the release assembly and into a hole (not shown) in reel bracket 28 when the release assembly is pivoted into the vertical position.

Figure 3:
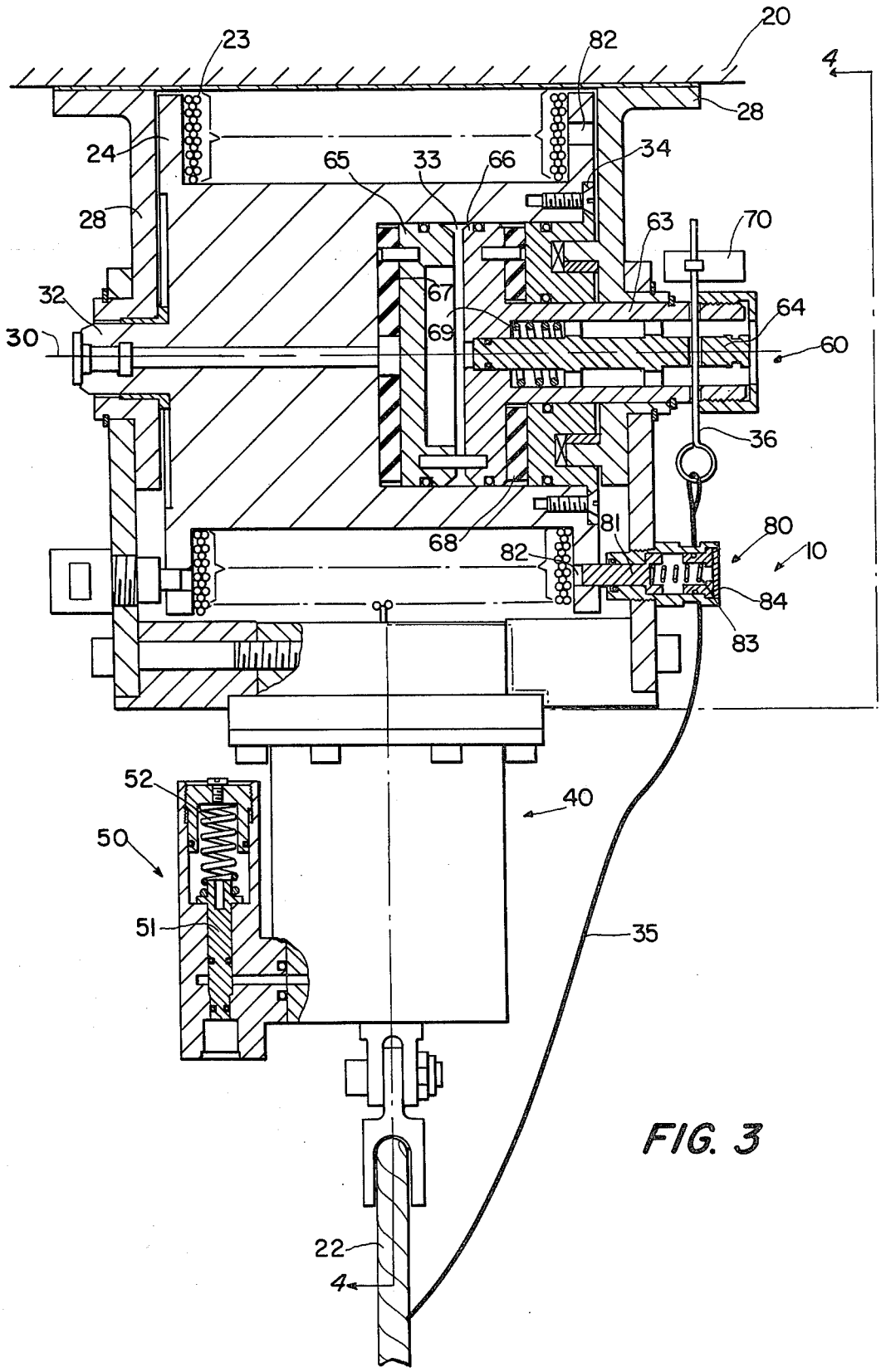
FIG. 3 shows a cross-sectional front view of the mooring system and storage reel.

Referring to FIG. 3, storage reel 24 is mounted on bracket 28 along axis 30. Reel 24 is held in a locked position by reel locking assembly 80 which is hydrostatically unlocked after the case is separated from the anchor. The reel is supported at one end by an integral projection 32 which is rotatably mounted in bracket 28. The opposite end of the reel is provided with a cylindrical cavity 33 in which is rotatably mounted a stationary brake assembly 60. Ring 34 retains brake assembly 60 in the cylindrical cavity.

Figure 4:
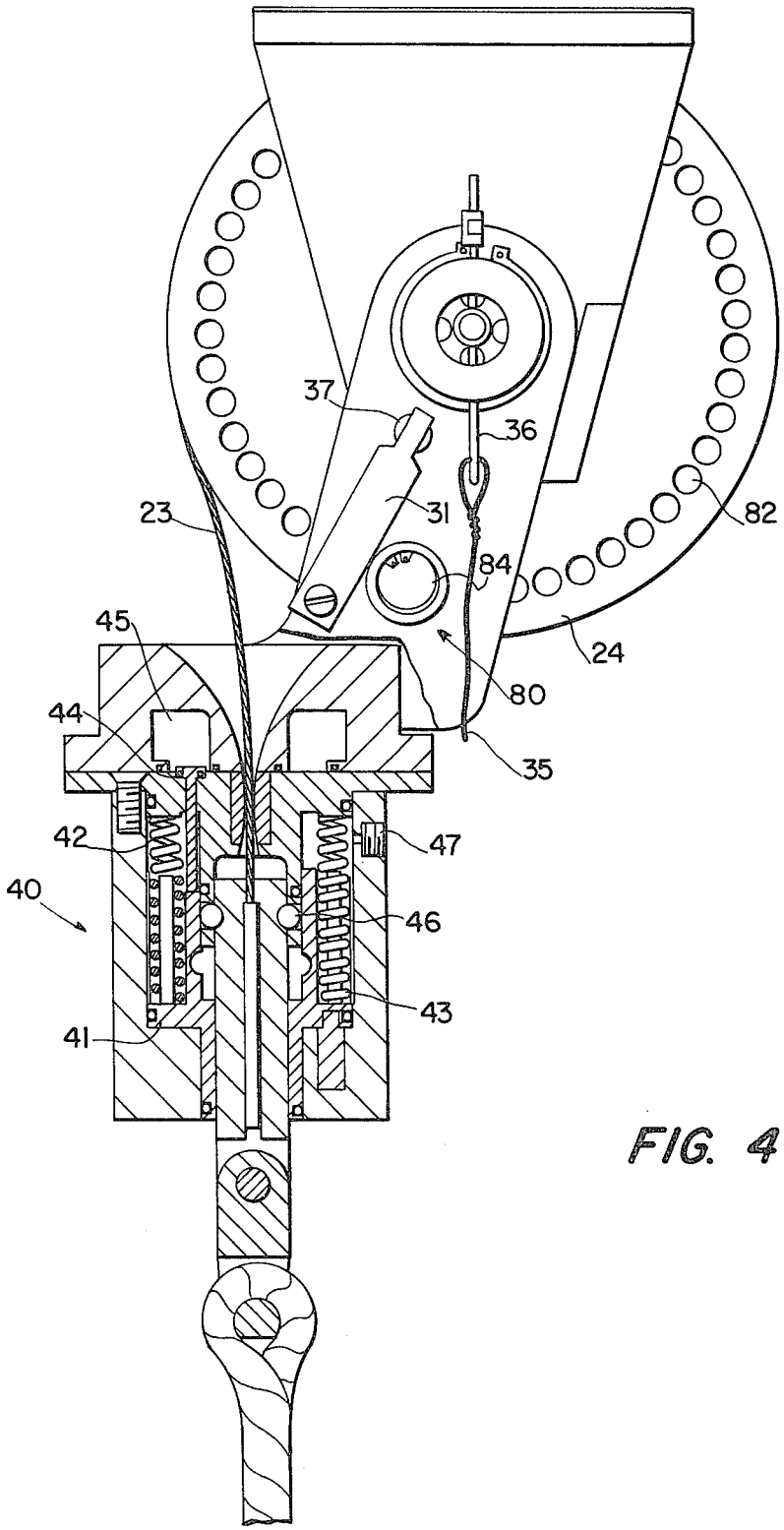
FIG. 4 shows a cross-sectional side view of the mooring system release assembly taken along line 4—4 of FIG. 3.

As illustrated in FIGS. 3 and 4, time delayed resilient line release assembly 40 is provided with a sensing piston assembly 50 having sensing piston 51 with adjustable sensing piston spring 52 which can be adjusted to vary the hydrostatic pressure at which the sensing piston operates. When the case passes the first preselected depth, the sensing piston operates to admit water pressure to time delayed resilient line release assembly 40.

Release assembly 40 is provided with a hollow actuating piston 41, mounted in chamber 42, which is responsive to the water pressure from sensing piston assembly 50. Movement of the actuating piston is opposed by a plurality of springs 43 which are mounted in chamber 42 so as to oppose the movement of actuating piston 41 in response to increasing water pressure. The portion of chamber 42 in which springs 43 are positioned is filled with a silicon base high viscosity fluid. A valve 44 is also positioned in chamber 42 so as to be in contact with actuating piston 41. When piston 41 is moved against the springs 43 by the increasing water pressure, valve 44 opens and releases the silicon fluid to a storage chamber 45. The slow passage of the silicon fluid through valve 44 retards movement of piston 41 and delays release of the resilient line. As piston 41 approaches the full length of its travel, a ball and detent fastener 46 is unlocked which allows resilient line 22 to be released from release assembly 40 causing mooring line 23 to payout from storage reel 24.

Chamber 42 is provided with a corrodible plug 47, of magnesium or similar material, which in contact with sea water dissolves, thus allowing water pressure to enter the chamber and balance the hydrostatic pressures acting on actuating piston 41. If the buoyant case is launched in shallow water, the dissolution of plug 47 balances actuating piston 41 and prevents the piston from moving and releasing ball and detent fastener 46 and thus insures that the case will remain permanently moored by the resilient line.

An actuating line 35 is connected at one end to the resilient line and at the opposite end to brake pin 36 which locks brake assembly 60 in an inoperative position. When the resilient line is released from the case, actuating line 35 pulls brake pin 36 to unlock the brake assembly.

Brake assembly 60, as shown in FIG. 3, is provided with first and second brake pistons 65 and 66 which are fitted respectively with oppositely facing brake pads 67 and 68. If necessary, the invention will function with a single brake piston. Brake pad 67 faces the closed end of brake cavity 33 and brake pad 68 faces retainer ring 34. Brake piston 66 is hollow so as to provide access to cavity 33 and is also fitted with a hollow projection 63 which passes through retainer ring 34 and reel bracket 28. A brake piston valve 64 is mounted in hollow projection 63 so as to block access through hollow second piston 66 to brake cavity 33. Brake piston valve 64 has hydrostatic pressure acting on one side and a brake valve spring 69 acting on the opposite side. The brake piston valve is locked in a non-braking position by pin 36 which passes through the brake piston valve and the hollow projection. Spring clip 70 is attached to pin 36 to prevent the pin from moving until withdrawn by actuating line 35.

When resilient line 22 is released by the time delay release assembly, actuating line 35 disengages brake pin 36 from brake piston valve 64. Hydrostatic pressure opposes the force of spring 69 to retain the brake piston in the hollow projection and thus prevent pressure from entering brake cavity 33. As the case ascends the hydrostatic pressure acting on the brake piston valve decreases and spring 69 displaces the brake piston valve and allows hydrostatic pressure into cavity 33. The hydrostatic pressure forces brake pistons 65 and 66 against the closed end of cavity 33 and retainer 34, respectively, to brake the storage reel and terminate the payout of mooring line.

Reel locking assembly 80 is provided with a spring loaded locking plunger 81 which engages one of a plurality of circumferentially positioned apertures 82 in reel 24. When the case and anchor separate, hydrostatic pressure overcomes the force of locking spring 83 so as to disengage locking plunger 81 from one of the plurality of apertures 82 and allow the reel to payout mooring line after the case has descended through the first preselected depth. After the case has ascended to the second preselected depth and the payout of mooring line has been terminated, a corrodible disc 84, such as magnesium or like material, dissolves to admit hydrostatic pressure to the spring loaded side of locking plunger 81. This balances the hydrostatic forces on the plunger and allows locking spring 83 to reinsert locking plunger 81 into one of the plurality of apertures 82 thus insuring that the reel is locked and the case is permanently moored at the second preselected depth.

It is thus apparent that the disclosed invention for mooring a buoyant case, such as a mine or other marine device, at a preselected depth provides a mooring system which is simple, reliable and compact and thus able to be launched by a surface, submerged or airborne platform and automatically moor the case at the preselected depth. The disclosed mooring system begins the time delayed payout of mooring line after a first preselected depth is reached, before the anchor reaches the ocean floor, and ceases payout at a second preselected depth, after the anchor has reached the ocean floor. The mooring system can also withstand the shock and oscillation associated with the termination of mooring line payout.

Obviously, many modifications and embodiments of the specific invention, other than those set forth above, will readily come to mind to one skilled in the art having the benefit of the teachings presented in the foregoing description and the accompanying drawings of the subject invention, and hence it is to be understood that the invention is not limited other than by the scope of the appended claims.

What is claimed is:

1. A mooring system for mooring a case in water at a preselected depth below the water surface from an anchor resting on the ocean floor comprising:

a case adapted to be moored in water;

an anchor;

means detachably securing the anchor to the case;

a line mooring the case to the anchor;

means positioned in said case for storing the mooring line;

means positioned in the case for initiating time delayed payout of the mooring line after said case has passed a first depth thereby permitting the anchor to descend to the ocean floor and the case to ascend toward the water surface; and means positioned in the case for terminating payout of the mooring line when the case has ascended through a second depth which is between the first depth and the water surface;

whereupon after launching of said case and anchor, said securing means detaches the anchor from the case as the case and anchor descend through the water, said initiating means begins the time delayed payout of the mooring line from the storage means after the case descends through the first depth, and said terminating means terminates the ascent of the case after the case has ascended through the second depth.

2. The mooring system of claim 1 wherein the means for initiating time delayed payout of the mooring line comprises:

a sensing piston assembly responsive to ambient hydrostatic pressure;

an actuating piston responsive to hydrostatic pressure from the sensing piston;

fluidic time delay means opposing the actuating piston; and means for payout of the mooring line from the case in response to the movement of the actuating piston;

whereupon after the case has passed the first depth, said sensing piston assembly is actuated by ambient hydrostatic pressure to admit hydrostatic pressure to the actuating piston which is actuated against the fluidic time delay means to payout the mooring line from the case.

3. The mooring system of claim 2 wherein the fluidic time delay means comprises:

a valve responsive to movement of the actuating piston;

a plurality of springs opposing movement of the actuating piston; and a fluid positioned between the valve and the actuating piston opposing movement of the actuating piston;

whereupon movement of the actuating piston against the plurality of springs in response to the ambient hydrostatic pressure opens the valve and allows the fluid to flow from between the actuating piston and the valve.

4. A mooring system as in claim 3 wherein the fluid is a silicon based fluid.

5. A mooring system as in claim 1 wherein the mooring line comprises a resilient line in series with a non-resilient line.

6. A mooring system as in claim 1 wherein the means for detachable securing the anchor to the case comprises a ball and groove retaining band secured with an explosive bolt.

7. A mooring system as in claim 1 wherein the means for terminating payout of the mooring line comprises a brake assembly including:

a hydrostatically responsive brake valve;

a pin engaging the brake valve and connected to the mooring line; and one or more brake pistons responsive to actuation of the brake valve;

whereupon payout of the mooring line from the case disengages the pin from the brake valve and permits the brake valve to respond to decreasing hydrostatic pressure thereby actuating the one or more brake pistons to terminate the payout of the mooring line.

8. The mooring system of claim 1 wherein the storage means is provided with means for locking said means prior to launching of the case and after termination of the payout of the mooring line.

9. The mooring system of claim 1 wherein the means for initiating payout of the mooring means is further provided with means for preventing payout of the mooring line if the case fails to descend through the first depth.

* * * * *